United States Patent [19]

Roeder

[11] 4,202,656

[45] May 13, 1980

[54] DOWNHOLE HYDRAULICALLY ACTUATED PUMP WITH JET BOOST

[76] Inventor: George K. Roeder, P.O. Box 4335, Odessa, Tex. 79760

[21] Appl. No.: 842,390

[22] Filed: Oct. 17, 1977

[51] Int. Cl.[2] ..... F04F 5/54

[52] U.S. Cl. ..... 417/88; 417/404

[58] Field of Search ..... 417/87, 88, 398, 403, 417/404, 391

[56] References Cited

U.S. PATENT DOCUMENTS

| | | | |
|---|---|---|---|
| 2,780,171 | 2/1957 | Heddy | 417/87 |
| 3,453,963 | 7/1969 | Roeder | 417/404 |
| 3,517,741 | 6/1970 | Roeder | 417/404 X |
| 3,650,640 | 3/1972 | Roeder | 417/396 |
| 3,773,437 | 11/1973 | Suman, Jr. | 417/87 |
| 3,788,771 | 1/1974 | Akins | 417/88 |
| 3,865,516 | 2/1975 | Roeder | 417/403 |
| 3,957,400 | 5/1976 | Roeder | 417/393 |
| 4,003,678 | 1/1977 | David | 417/88 |

*Primary Examiner*—Carlton R. Croyle
*Assistant Examiner*—Edward Look
*Attorney, Agent, or Firm*—Marcus L. Bates

[57] ABSTRACT

A subsurface hydraulically powered pump assembly having a reciprocating pump end, a reciprocating engine end, a valve assembly for controlling the flow of power fluid to and from the engine, and a jet-type pump incorporated therewith which utilizes either the spent power fluid, or alternatively, utilizes fresh power fluid in boosting the action of the reciprocating pump. The invention comprehends utilizing the jet action to supplement the engine action at either the pump suction or the pump exhaust, thereby enabling a considerable variation in the size of the pump and engine piston, and furthermore enabling a conventional downhole reciprocating pump to move an increased volume of fluid to a greater height.

2 Claims, 5 Drawing Figures

DOWNHOLE HYDRAULICALLY ACTUATED PUMP WITH JET BOOST

BACKGROUND OF THE INVENTION

Lifting oil from the bottom of a wellbore to the surface of the earth is sometime more costly than the profit derived from the crude, and therefore, on marginal wells, an improvement in efficiency often spells the difference between abandonment of valuable crude oil as contrasted to continued production of the well. In deep wells where the reservior no longer has sufficient bottom hole pressure to free-flow the well, it is common to use a bottom hole hydraulically actuated reciprocating pump assembly as evidenced by my U.S. Pat. Nos. 3,517,741; 3,650,640; 3,453,963; 3,957,400; and 3,865,516. As the production formation of a well continues to be depleted, and the lifting force required to bring the oil to the surface of the ground continues to increase, additional energy must be expended by the engine of the pump assembly, or alternatively, the size of the pump piston must be decreased in order that sufficient lifting force be available for pumping the crude from the pay zone up to the surface of the earth.

It is therefore desirable to be able to use a relatively large downhole pump assembly for lifting a relatively large volume of crude by augmenting the action of the downhole pump so as to boost the pump action. Otherwise, increased hydraulic pressure must be resorted to in order to achieve the greater lifting force, and ultimately the greater forces exerted on the engine and pump assembly will rapidly deteriorate the entire apparatus so that it wears out early in its life.

It would be therefore be desirable to incorporate such a jet boosting action in any number of different downhole reciprocating-type pumps, as for example, one of the above mentioned prior art Roeder pumps.

SUMMARY OF THE INVENTION

This invention generally relates to a means by which the pumping action of a downhole reciprocating pump assembly can be augmented by a jet-type pump which is incorporated therewith.

More specifically, the invention relates to a downhole hydraulically powered pump assembly having a power fluid inlet by which the engine of the pump assembly is actuated, a valve assembly by which power fluid and spent power fluid is conducted to and from the engine, a pump end which is reciprocated by the engine pistons, and a jet-type pump for boosting the action of the pump end. The lifting force provided by the hydraulically powered reciprocating pump assembly is augmented by the action of the jet pump by placing the jet pump at the downstream end of the pump end, or alternatively, placing the jet pump at the upstream end of the pump end.

The jet pump is powered by the same power fluid which has been utilized by the pump engine, or alternatively, by directly utilizing the fresh power fluid before part of the energy has been extracted therefrom by the pump engine.

Accordingly, a primary object of the present invention is the provision of a combination reciprocating pump assembly and a jet-type pump for producing fluid from a wellbore.

Another object of the invention is the provision of a means which enables an increase in the size of the production piston of a downhole pump assembly by reducing the hydrostatic load acting on the pump end piston or pistons.

A further object of this invention is the employment of a power source to operate a jet booster pump which includes a simplified bottomhole assembly cavity in both conventional and free-type pump installations.

A still further object of this invention is the provision of a safety factor which guards against downhole pump failure which is realized from the employment of two diverse pumping means in a well as contrasted to a single pumping means.

Another and still further object of this invention is the utilization of prior art downhole hydraulically actuated pumps in wells which are too deep for the specific selected pump by reducing the pressure of power oil to a value which is less than is normally required to actuate the pump engine.

An additional object of the present invention is the provision of a combination of a reciprocating type downhole hydraulically actuated pump placed in series or parallel flow relationship respective to a jet-type pump to thereby reduce the power requirements of both the reciprocating and jet-type pump when either pump is considered alone.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Throughout the various figures of the drawings, wherever it is practical or logical to do so, like or similar numerals will refer to like or similar elements.

Figure 1:
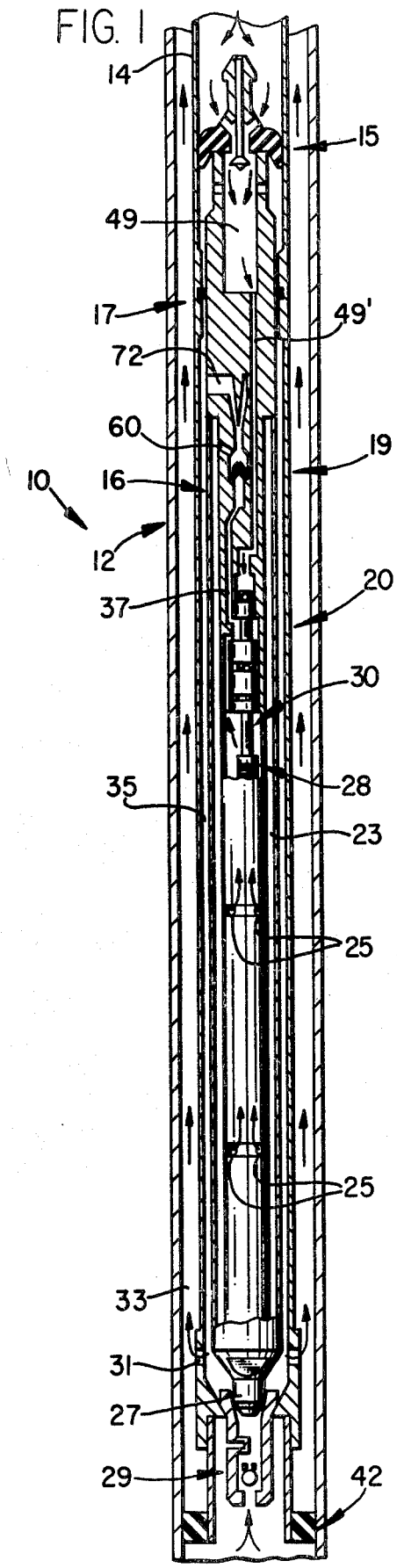
FIG. 1 is a longitudinal, part diagrammatical, part schematical, part cross-sectional representation of a combination downhole hydraulically actuated reciprocating pump assembly and jet-type pump made in accordance with the present invention.

In FIG. 1, there is disclosed a pump assembly 10 made in accordance with the present invention which is located downhole in a wellbore. The wellbore is cased, as indicated by the numeral 12, so that a power tubing 14 can be run downhole in a conventional manner. A hydraulically actuated pump assembly 16 of the free-type is located within the pump cavity and includes a packer nose assembly generally indicated by the numeral 15. A fixed type pump could equally well be utilized by eliminating the packer nose assembly and directly connecting the pump to the power tubing in a manner known to those skilled in the art. The power tubing includes an o-ring collar 17 where a free-type pump is employed.

A jet action type pump 19, preferably made in accordance with my co-pending patent application Ser. No. 803,977 filed June 6, 1977, is provided for boosting the action of a conventional hydraulically actuated reciprocating type pump assembly seen therebelow.

The engine end of the reciprocating pump assembly includes a valve assembly 20 made in accordance with either of my previously mentioned issued patents. Numeral 28 indicates the upper end of the uppermost engine piston which forms a working chamber 30, which is illustrated in conjunction with the valve assembly as being on the upstroke or exhaust position. Annulus 23 provides a flow path from the exhausting production fluid outlet ports 25 so that fluid can flow along an isolated flow path up towards the jet pump.

The lower marginal end portion 27 of the pump is received in seated relationship within a free-type standing valve 29, the details of which are more specifically disclosed in my issued Pat. No. 3,517,741. Radially spaced production ports 31 are formed within the standing valve and communicate the casing annulus 33 with the annulus formed between the power tubing and the main pump housing.

A spent power fluid flow passageway 37 is located within the engine housing and interconnects flow from the valve assembly 20 with the high pressure intake of the jet pump 19 so that a flow of relatively high pressure fluid occurs through the illustrated nozzle, while at the same time produced fluid is forced to flow from the annular passageway 23, into the low pressure jet intake port 60, with the mixed fluid flow continuing through the jet pump and through the jet pump outlet 72 where the fluid then flows down through annulus 35, port 31, and up through the casing annulus 33.

Figure 2:
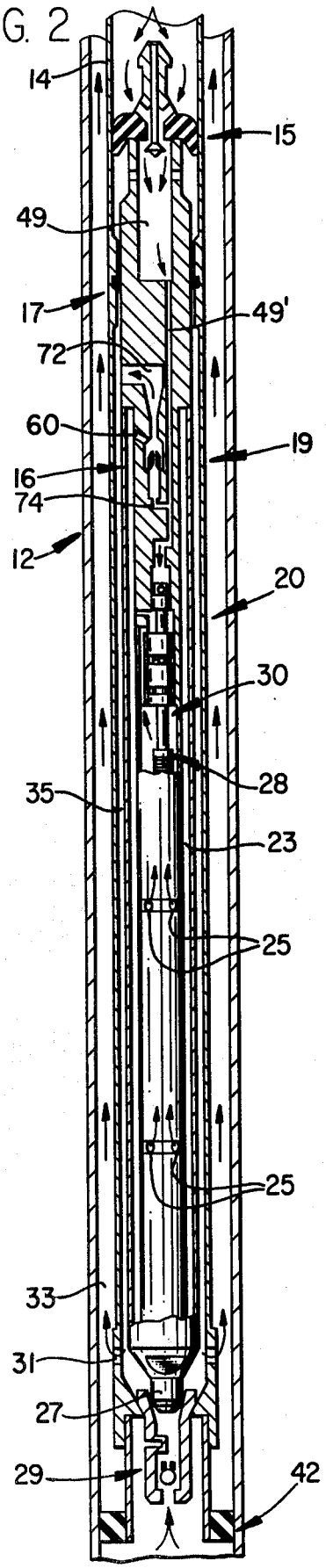
FIG. 2 is a longitudinal, part cross-sectional, part diagrammatical, part schematical representation of a modification of the downhole pump assembly seen illustrated in FIG. 1.

In FIG. 2, power fluid flows into the packer nose section and into chamber 49 of the engine, through a power fluid flow passageway 49', where the passageway then branches into two flow passageways. One passageway flows on to the valve assembly 20, with the other passageway thereof continuing at 74 into the high pressure inlet of the jet pump. Accordingly, the jet pump and the valve assembly of the engine of FIG. 2 are placed in parallel flow relationship respective to the source 49 of hydraulic fluid pressure, and the spent power fluid from the valve means admixes with the produced fluid before entering the jet pump intake 60.

Figure 3:
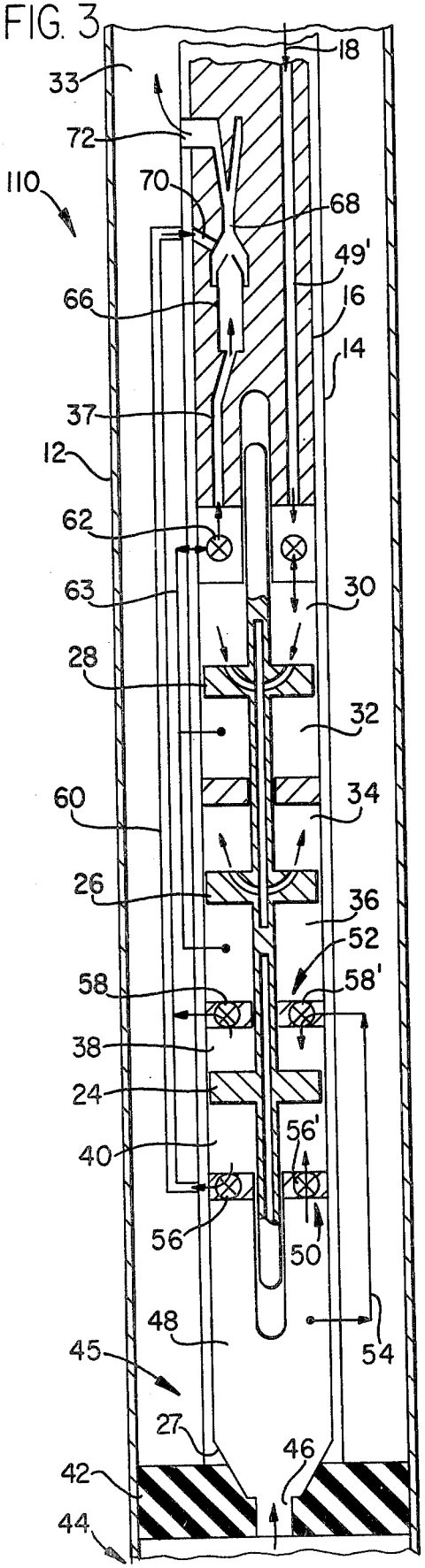
FIG. 3 is a longitudinal, part cross-sectional, part diagrammatical, part schematical representation of another form of a downhole pump made in accordance with the present invention.

In the embodiment of FIG. 3, the downhole pump assembly 110 is provided with an engine made in accordance with my previously issued U.S. Pat. No. 3,453,963, to which reference is made for the operative details thereof. A rod 22, which is hollow along a portion of its length, is rigidly affixed to pump piston 24, lower engine piston 26, and upper engine piston 28. The pistons of the entire pump assembly divide their respective illustrated working chambers into chambers 30, 32, 34, 36, 38, and 40.

Packer 42 isolates the formation fluid contained in the lower casing 44 (containing a perforated production zone) from an upper annulus 45 so that formation fluid flows through the foot valve at 46 and into the formation fluid intake chamber 48.

Valve housing 50 separates chambers 40 and 48 from one another and provides a housing within which the illustrated valves are located so that formation fluid is free to be ingested into chamber 40. Pump valve housing 52 likewise includes the illustrated valves therein and enables formation fluid to be ingested into chamber 38 by means of the schematically illustrated flow conduit 54, which can be an external piping, or radially drilled passageways formed within the sidewall of the pump housing.

Outlet valves 56 and 58 are located within valve housings 50 and 52, and are flow connected to the schematically illustrated passageway 60 so that fluid produced by the pump end can flow along an isolated flow path up to the jet pump.

The schematically illustrated valve 62 indicates that spent power fluid is alternately exhausted from chambers 32 and 36, and exhausts into a spent power fluid passageway 37 by employment of any suitable flow passageway, such as schematically illustrated by the numeral 63. Valve 64 of the control valve means schematically illustrates that the control valve alternately shifts to cause power fluid to flow from the power fluid source 18 into chambers 30 and 34 by means of the flow passageway formed through the hollow connecting rod 22.

Numeral 66 indicates a high pressure nozzle of the jet pump which directs flow into a venturi 68, thereby reducing the pressure in the vicinity of an intake 70 so that fluid from the pump end is forced to flow along with the fluid from nozzle 66, through the jet pump, and through the outlet 72.

Figure 4:
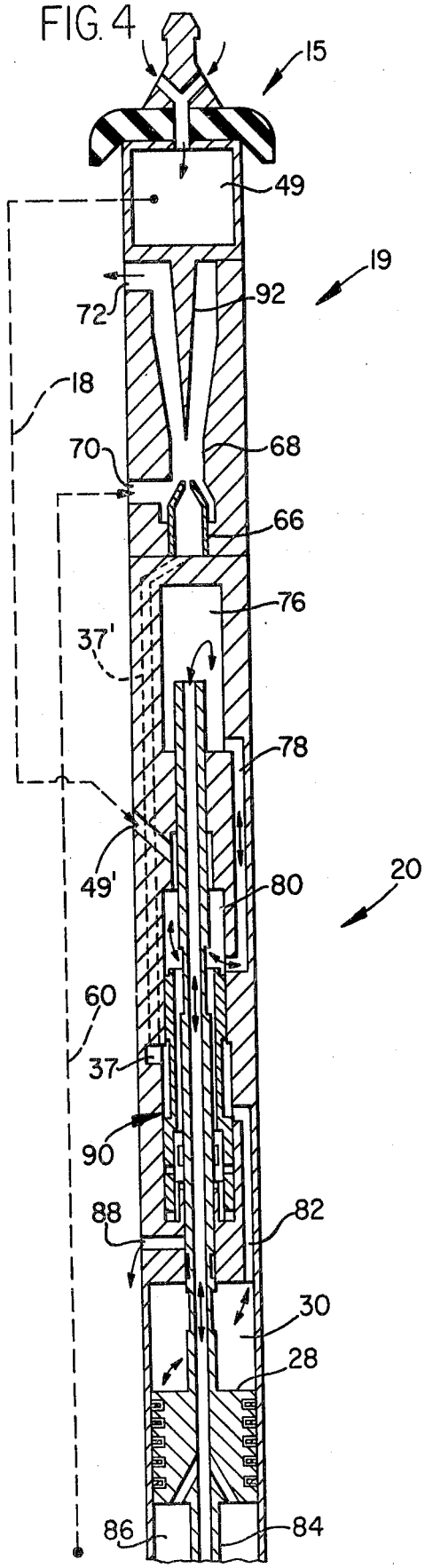
FIG. 4 is a fragmented, longitudinal, cross-sectional view of still another downhole pump made in accordance with the present invention; and, FIG. 5 sets forth one embodiment of part of the apparatus disclosed in the foregoing figures.

In the embodiment of FIG. 4, the jet boost pump 19 has the nozzle 66 thereof connected to a drilled passageway 37'. The passageway is located radially within the body and extends longitudinally therethrough and into communication with a spent power fluid exhaust port 37 of the control valve assembly. Fluid chamber 76 reciprocatingly receives the marginal end of rod 28' therein, thereby forming a fluid flow passageway to and from the valve assembly by means of a passageway 78 which is connected to a valve chamber 80.

Passageway 82 connects engine chamber 30 to the traveling valve element 90 so that power fluid and spent power fluid alternately flow through passageway 82 as the engine upstrokes and downstrokes.

Rod 84 continues to a second piston located therebelow as more specifically seen in my previously issued U.S. Pat. No. 3,865,516. Chamber 86 is alternately connected to a power and spent power fluid source in accordance with the last mentioned patent.

OPERATION

The downhole hydraulically powered pump assembly of the present invention has a power fluid inlet 49, a spent power fluid outlet 37, a production fluid inlet 27, and a production fluid outlet 25. The engine includes at least one cylinder 30 within which a piston 28 is reciprocatingly received as shown in FIG. 3.

A control valve assembly 20 is connected to cause power fluid to flow to the engine, thereby causing the piston to reciprocate, and accordingly, spent power fluid to flow through the spent power fluid outlet.

The production pump has at least one cylinder, with a pump piston 24 reciprocatingly received therewithin; and means, such as the connecting rod 22, connecting the engine and pump pistons together. Production valve means at 50 and 52 are flow connected to the pump cylinders so that the reciprocating pump piston forces production fluid to flow from the formation fluid inlet 48 to the produced fluid outlets 56 and 58.

A jet pump apparatus 19, such as seen in FIG. 3, has a high pressure inlet at 37, a low pressure fluid inlet at 60, and a mixed fluid outlet at 72. Flow conduit means connects the produced fluid outlet to said low pressure fluid inlet 60, and means connects said high pressure fluid inlet 37 to a hydraulic pressure source, such as the spent power fluid from the valve assembly, or alternatively, the fresh power fluid source at 49, so that a force is available for establishing the venturi action and causing the fluid flow through the entire pump assembly to be boosted.

The mixed fluid outlet 72 is conducted to the surface of the ground along the annular flow path 33, although in some instances piping may be used to connect the formation fluid and spent power fluid to the surface of the ground.

The free-type pump of FIG. 1 has been circulated downhole so that the lower end thereof is placed in fluid communication with the free standing valve and formation fluid can accordingly enter the intake of the production end so that the pump can move fluid through the produced outlet ports 25 and up to the intake 60 of the jet pump.

Power fluid flows down the power tubing, through the passageway 49', and to the valve assembly where the power fluid is alternately flow connected to and from the power cylinder chambers of the engine, thereby reciprocating pistons of the engine which in turn reciprocates the pistons of the production pump.

Spent power fluid from the valve assembly flows along passageway 37 and to the nozzle of the jet pump thereby boosting the flow from the production end so that mixed fluid flow emerges at 72, flows down annulus 35, through ports 31, and up the casing annulus to the surface of the ground. Alternatively, separate piping means can be employed for the last fluid flow path.

As seen in FIG. 2, the jet pump and engine section may be connected in parallel so that a much higher fluid force is available to the nozzle at 74, so that the produced fluid from the pump section is forced uphole with greater power availability.

In the embodiment of FIG. 3 there is diagrammatically disclosed a longitudinal cross-section which presents additional details of the engine and pump section. In FIG. 3, power fluid is available at 49' for the control valve 20, so that power fluid flows into chamber 30 and simultaneously into the hollow rod, down to piston 26, and out into the chamber 34, thereby driving pistons 28 and 26 in a downward direction.

Simultaneously valve 62 enables spent power fluid to flow by means of flow conduit 63, from lower chambers 32 and 36, and up to passageway 37, where the fluid continues to flow into nozzle 66. It should be understood that valves 62 and 64 are a simplified diagrammatical illustration of the actual valve assembly found in U.S. Pat. No. 3,453,963, for example.

As the engine upstrokes, power fluid flows from source 49' into the valve assembly, through the schematically illustrated valve assemblies 62 and 64, down through conduits 63 where the power fluid is available at chambers 32 and 36 for upstroking the engine. Simultaneously spent power fluid is exhausted from lower chamber 34, into the hollow rod, into chamber 30, back through valve 64, and to passageway 37 thereby providing nozzle 66 with a source of spent power fluid.

As the engine reciprocates the connecting rod 22, the production piston 24 moves therewith, chambers 38 and 40 are alternately filled with formation fluid from source 48 by means of valves 56' and 58' of valve assemblies 50 and 52, while the appropriate pump chamber exhausts into conduit 60 by means of valves 56 and 58 of the valve assembly.

In the embodiment of FIG. 4, power fluid enters the packer nose section and is available at 49 so that a flow passageway 18 conducts the power fluid down to the valve assembly at 49' so that power fluid is available within power fluid chamber 80. As the engine reciprocates, chamber 80 is alternately connected to passageways 78 and 82 so that chamber 30 is alternately connected to a power fluid source and a spent power fluid flow passageway 37. Lower chamber 86 is similarly connected to passageways 78 and 37 on the alternate stroke.

Production fluid from the production pump end (not shown) flows up conduit 60 and to the jet pump intake 70 where the fluid is sucked into the venturi 68, up through the jet pump, and through the outlet 72 where the fluid continues to flow to the surface of the ground.

Figure 5:
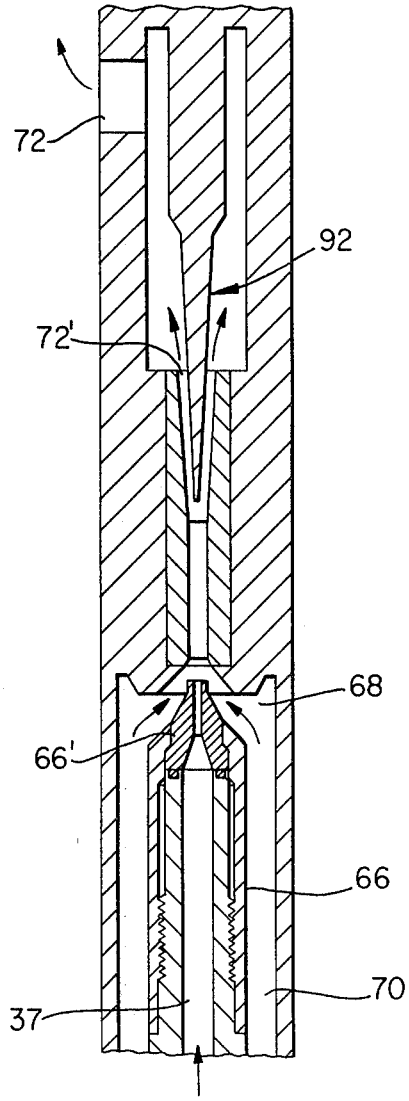

FIG. 5 schematically sets forth the details of a jet pump in combination with another downhole pump assembly.

The present invention reduces the power source requirement by employing a booster pump to help reduce the hydrostatic force load acting on the hydraulic bottom hole pump by the provision of a jet booster pump made in accordance with the present invention.

I claim:

1. A downhole hydraulically actuated pump assembly for lifting fluid from a borehole, a power tubing means connected to supply power fluid to the pump assembly, a formation fluid inlet means connected to supply formation fluid to the pump assembly, and a produced fluid flow path connected to the pump assembly through which produced and spent power fluid flows to the surface of the ground;

said pump assembly includes a jet pump having a high pressure inlet, a lower pressure intake, and an exhaust, a double acting engine end, a control valve assembly, and a double acting production end;

said production end includes pistons reciprocatingly received in a cylinder thereof with production valve means connected to receive a flow of formation fluid thereinto and to force the produced fluid to substantially continuously flow towards said intake of said jet pump;

means connecting said engine end to actuate said pump end, said engine end having a power fluid inlet and a spent power fluid outlet, and a piston means reciprocatingly received within a working cylinder, means connecting said engine piston to actuate said pump piston;

means by which said control valve assembly conducts power fluid to and spent power fluid from said engine to cause the engine piston to reciprocate;

means connecting a source of high pressure fluid to said high pressure inlet of said jet pump, means connecting a source of produced fluid to said intake of said jet pump such that energy is extracted from the high pressure fluid in order to boost the flow of produced fluid up the produced fluid flow path;

said jet pump is mounted above said control valve means, while said engine end is interposed between said production end and said control valve means;

said jet pump has the high pressure inlet thereof connected to the spent power fluid flowing from said control valve assembly while the produced fluid from the production end is connected to the low pressure inlet of the jet pump;

so that the produced fluid and the spent power fluid is admixed within the jet pump as the flow of the produced fluid is boosted.

2. A downhole hydraulic powered pump assembly having a power fluid inlet, a formation fluid inlet, and a fluid outlet;

said pump assembly includes an engine end having a cylinder, a double acting piston reciprocatingly received within said cylinder, a spent power fluid outlet; means including a control valve assembly connected to cause power fluid to flow to said engine end to cause said piston to reciprocate and spent power fluid to flow to said spent power fluid outlet;

a double acting production end having a cylinder, a production piston reciprocatingly received within the last said cylinder, a produced fluid outlet, means connecting the piston of the end and the piston of the production end together; production valve means connected such that the piston of the production end forces a flow of production fluid to occur from the formation fluid inlet to said produced fluid outlet each stroke of the piston of the production and engine ends;

said pump assembly includes a jet pump apparatus having means forming a high pressure fluid inlet, a low pressure fluid inlet, and a mixed fluid outlet; means connecting said produced fluid outlet to said low pressure fluid inlet, means connecting said high pressure fluid inlet to a source of high pressure fluid; said jet pump includes a nozzle means by which the flow of high pressure fluid augments the flow of low pressure fluid, and means by which said mixed fluid outlet can be conducted to the fluid outlet of the pump assembly and to the surface of the ground;

said high pressure source of fluid is the spent power fluid outlet which originates at the engine end and is conveyed to the jet pump by a conduit means mounted above said control valve assembly, while said engine end is interposed between said production end and said control valve assembly.

* * * * *